United States Patent [19]

McAbee et al.

[11] Patent Number: 4,710,598

[45] Date of Patent: Dec. 1, 1987

[54] DISTRIBUTOR FOR MULTI-CYLINDER ENGINE

[75] Inventors: Mac P. McAbee, 3136 Cottage Grove, Des Moines, Iowa 50311; Deloss J. Biddle, Urbandale, Iowa

[73] Assignee: Mac Patrick McAbee, Des Moines, Iowa

[21] Appl. No.: 945,035

[22] Filed: Dec. 22, 1986

Related U.S. Application Data

[63] Continuation-in-part of Ser. No. 826,989, Feb. 7, 1986, Pat. No. 4,658,103.

[51] Int. Cl.[4] ..... H01H 19/04

[52] U.S. Cl. ..... 200/21; 123/146.5 A; 123/595; 200/19 DC

[58] Field of Search ..... 200/19 DC, 19 A, 21, 200/304, 305; 123/595, 146.5 A

[56] References Cited

U.S. PATENT DOCUMENTS

| | | | |
|---|---|---|---|
| 1,447,745 | 3/1923 | Atkinson | 200/25 |
| 1,566,888 | 12/1925 | Luckeman | 200/20 |
| 1,811,498 | 6/1931 | Geloso | 200/305 X |
| 2,766,338 | 10/1956 | Jamieson et al. | 200/24 |
| 2,997,552 | 8/1961 | Silverschotz | 200/24 |
| 3,270,150 | 8/1966 | Stevens | 200/24 |
| 3,506,796 | 4/1970 | Roschilla | 200/19 A |
| 4,121,064 | 10/1978 | Nakajima et al. | 200/19 A |
| 4,315,487 | 2/1982 | Wyatt, Sr. | 200/19 DC X |

*Primary Examiner*—J. R. Scott
*Assistant Examiner*—Morris Ginsburg
*Attorney, Agent, or Firm*—Zarley, McKee, Thomte, Voorhees & Sease

[57] ABSTRACT

The distributor of the present invention includes a housing having condenser and points therein and having a rotor adapted to actuate the points for producing intermittent pulses of current at an outlet connector. A dielectric disk is attached to the rotor and is adapted to rotate in unison therewith. A gasket provides a physical barrier between the conductive sheet which is above the gasket and the rotor, condenser and points which are below the gasket. A cap is mounted over the distributor housing and includes a pair of contact points which are adapted to be electrically connected one at a time to the conductive sheet on the disk during rotation of the disk. The two contact points on the cap include leads which lead to the sparkplugs of the engine. A single discharge coil includes a discharge post which is connected to a brush within the distributor cap. The brush extends downwardly through the cap and is in electrical connection with the conductive sheet at all times during rotation of the conductive sheet. The discharge coil also includes an input connection which is connected to the output of the distributor for receiving pulses of electricity therefrom.

9 Claims, 7 Drawing Figures

PLUG
COIL
PLUG
1 ST PLUG
2ND PLUG
DIST. CAP

DISTRIBUTOR FOR MULTI-CYLINDER ENGINE

BACKGROUND OF THE INVENTION

This is a continuation-in-part of pending application filed Feb. 7, 1986 Ser. No. 826,989 now U.S. Pat. No. 4,658,103, dated Apr. 14, 1987.

The present invention relates to a distributor for a multi-cylinder engine, and particularly to a distributor for use with a multi-cylinder engine such as the two cylinder engines commonly used in motorcycles.

Present motorcycle engine distributors include a dual discharge coil which has two discharge posts thereon. The coil is actuated intermittently and in response to this actuation, the coil delivers an output impulse of energy simultaneously to both of the two discharge posts. The discharge posts are connected to the sparkplugs of the cylinders.

The result of the above configuration is that the sparkplugs for both of the two cylinders are fired simultaneously. When the sparkplugs are fired simultaneously, one of the cylinders is in its power stroke and the other of the cylinders is in the exhaust portion of its stroke. The result of firing both cylinders at the same time is that the engine runs unevenly and noisely. Furthermore, the actuation of both sparkplugs at the same time reduces the efficiency of the engine since one of the cylinders is always firing on the exhaust portion of its stroke.

Therefore, a primary object of the present invention is the provision of an improved distributor for a multi-cylinder engine.

A further object of the present invention is the provision of a distributor which can be utilized in combination with a single discharge coil rather than a dual discharge coil as in prior devices.

A further object of the present invention is the provision of an improvement to a distributor which can be used to modify present distributors by merely replacing the distributor cap on present distributors and inserting a disk and a gasket on the top of the rotor of the present distributor.

A further object of the present invention is the provision of an improved distributor which is efficient in operation, durable in use, and economical to manufacture.

SUMMARY OF THE INVENTION

The present invention involves replacing several components in present distributors. To modify present distributors to incorporate the present invention, it is necessary first to remove the distributor cap. Within the distributor housing are the condenser, rotor and contact points. The present invention contemplates placing a disk and an insulator gasket over the rotor, and keying the disk to the rotor so that it will rotate in unison therewith. The disk is made of dielectric material, and includes a wedge-shaped piece of conductive material mounted thereto. A new distributor cap is provided which includes a pair of contact points on the undersurface thereof. These contact points are positioned so as to be engaged by the conductive sheet during rotation of the disk beneath the new distributor cap. A brush extends downwardly through the center of the distributor cap and is in electrical contact with the conductive sheet of the disk at all times during rotation of the disk.

A single discharge coil includes a single outlet post which is connected to the brush located in the center of the distributor cap. The discharge coil is also connected to the outlet portion of the distributor from the circuitry connecting the condenser and points.

In operation, during rotation of the rotor within the distributor, intermittent surges of current are sent to the single discharge coil. The discharge coil then transmits pulses of electricity to the brush located in the center of the distributor cap. These surges of electricity are conducted downwardly through the brush to the conductive sheet located on the disk. The disk rotates in unison with the rotor, and consequently the conductive sheet on the top of the disk moves into contact with each of the plug contacts one at a time so as to transmit pulses of electricity one at a time to each of the two sparkplugs. The result of this arrangement is that each of the sparkplugs are actuated one at a time rather than simultaneously as in prior devices.

DETAILED DESCRIPTION OF THE PREFERRED EMBODIMENT

Figures 1, 2, 3, 5A, 5B:
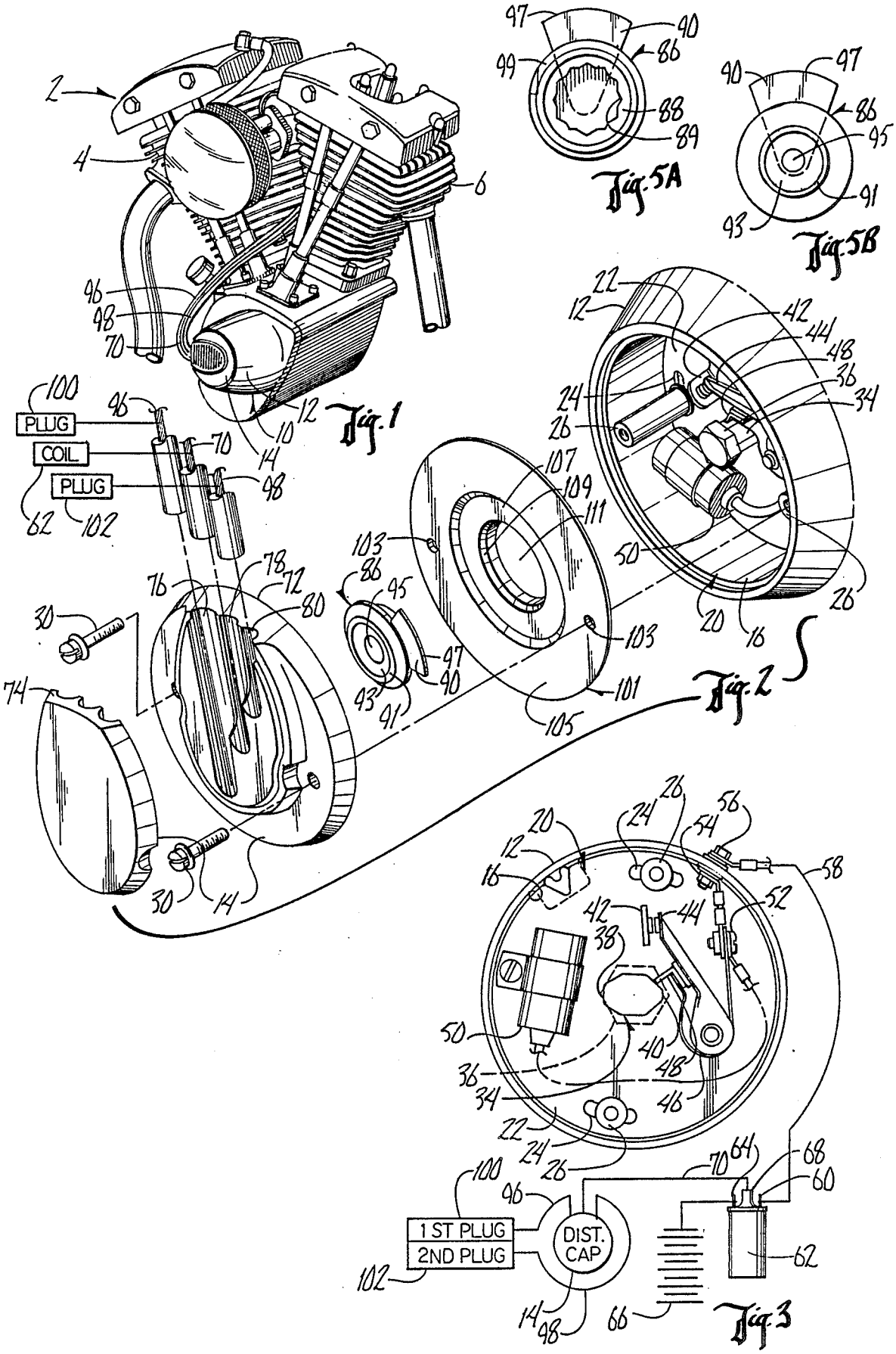
FIG. 1 is a perspective view of a two cylinder engine having a distributor as modified by the present invention.
FIG. 2 is an exploded perspective view showing the various components of the improved distributor.
FIG. 3 is a schematic diagram showing the inter-connection of the various components of the present invention.
FIGS. 5A and 5B are bottom and top views respectively of the disk used with the present invention.

Referring to the drawings, the numeral 2 designates an engine having two cylinders 4, 6 and being equipped with a modified distributor 10 of the present invention. Distributor 10 includes a lower housing 12 and a distributor cap 14. Housing 12 includes a circular sidewall 16, a bottom wall 18, and a base plate 22 which forms an upper compartment 21 and a lower compartment 23. Base plate 22 includes a pair of arcuate slots 24 therein. Slots 24 permit the base plate 22 to be rotated so as to permit manual adjustment of the spark timing. A pair of bolt connectors 26 include bottom portions 28 which extend through slots 24 and which are threadably received in the distributor housing 12. The upper portions of bolt connectors 26 include hollow threaded receptacles for receiving bolts 30 which extend through cap 14 and which hold cap 14 in covering relation over the upper end of sidewall 16 so as to completely enclose compartment 20.

A cam shaft 35 rotatably extends upwardly through bottom wall 18 and through base plate 22, and includes a rotor 34 mounted on its upper end. Rotor 34 includes a nut 36 on its upper surface, and includes a pair of oppositely positioned cam lobes 38, 40.

Mounted to base plate 22 is a fixed contact point 42 which is grounded through the distributor housing. Also mounted to plate 22 is a movable contact point 44 which is biased toward contact point 42 by a spring 46. A cam follower 48 is connected to movable contact point 44 and is adapted to bear against the cam lobes 38, 40 of rotor 34 during rotation of rotor 34. As each cam lobe 38, 40 engages cam follower 48, it causes contact point 44 to move away from contact point 42 for a short period of time.

A condenser 50 is mounted on base plate 22 and is grounded through the distributor housing. Condenser 50 is connected to a terminal 52 which is in electrical connection with spring 46 and which provides electrical connection to movable contact 44. An outlet lead 54 is also connected to terminal 52 and leads outwardly through sidewall 16 to an outlet terminal 56 outside housing 12.

Connected to outlet terminal 56 is a connecting wire 58 which is also connected to an inlet terminal 60 on a single discharge coil 62. Coil 62 includes a second coil terminal 64 which is adapted to be connected to an electrical power source 66. Coil 62 includes a single discharge post 68 which is adapted to send pulses of current to a discharge coil wire 70 which leads to the center of distributor cap 14.

Figure 4:
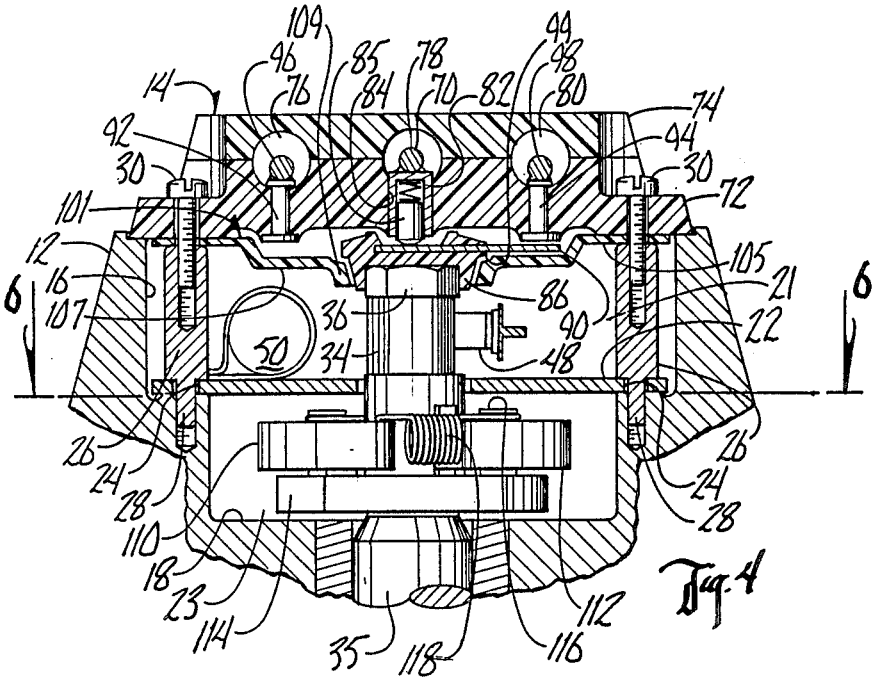
FIG. 4 is a sectional view showing the internal arrangement of the parts in the distributor.
Figure 6:
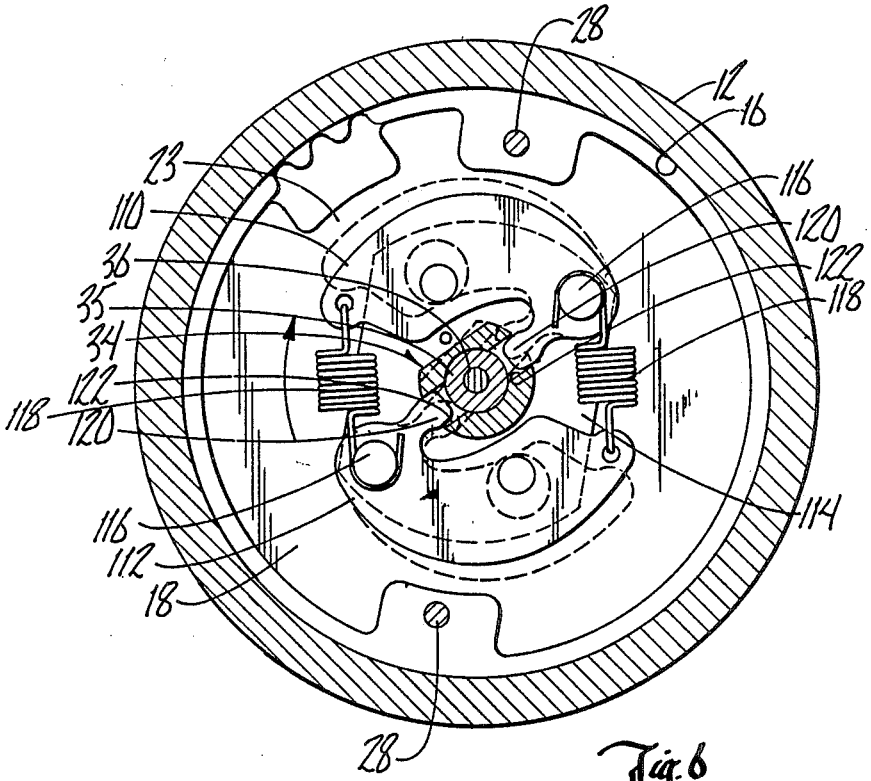
FIG. 6 is a sectional view taken along line 6—6 of FIG. 4.

As can be seen in FIGS. 2 and 4, distributor cap 14 includes a lower cap member 72 and an upper cap member 74. Upper cap member 74 is glued or otherwise secured over lower cap member 72 and forms three channels 76, 78, 80 therebetween. The central channel 78 receives the coil wire 70 which extends inwardly to the center of cap 14 where it is in electrical connection with a coil spring 82 which extends downwardly through a central opening 84 in cap 14. A cylindrical carbon brush 85 is slidably mounted within central opening 84 and is urged downwardly by coil spring 82.

Mounted over the nut 36 of rotor 34 is a circular dielectric disk 86 which has a receptacle 88 adapted to fit in mating engagement over nut 36 so that disk 86 will rotate in unison with rotor 34. Receptacle 88 has twelve apices 89 for receiving hex nut 36 of rotor 34. The fact that there are twelve apices 89 permits precise rotational positioning of disk 86 relative to rotor 34. Mounted to disk 86 is a pie-shaped or wedge-shaped conductive sheet 90 which extends from the center of disk 86 radially outwardly beyond the outer periphery thereof. The upper surface of disk 86 includes an annular ridge 91 which surrounds a central dish like depression 93. The conductive sheet 90 has its inner end 95 exposed at the center and bottom of depression 93 and has its outer end 97 projecting radially outwardly from disk 86. Disk 86 also has an annular flange 99 extending radially outwardly above the upper end of receptacle 88.

A pair of sparkplug contacts 92, 94 are mounted on the under surface of cap 14. Contacts 92, 94 comprise rivet-like members which extend upwardly into the channels 76, 80 in cap 14. A pair of sparkplug wires 96, 98 are electrically connected to the upper ends of contact points 92, 94 and extend outwardly through channels 76, 80 for electrical connection to a pair of sparkplugs 100, 102.

A circular dielectric gasket 101 includes two openings 103 which receive bolts 30 for securing gasket 101 in covering relation over distributor compartment 20. Gasket 101 has an outer annular horizontal flange 105 which rests on the upper ends of bolt connectors 26. Located inwardly from flange 105 are a first circular recess 107, an annular ring 109, and a central opening 111. Opening 111 is sized to permit receptacle 88 of disk 86 to protrude downwardly therethrough as shown in FIG. 4. In this position, annular flange 99 of disk 86 engages annular ring 109 of gasket 101 and limits downward movement of disk 86. Recess 107 of gasket 101 provides a space for the outer edge 97 of metal sheet 90 to rotate.

In order to adapt a conventional motorcycle distributor to the present invention, all that is necessary is to remove the conventional distributor cap and place gasket 101 in the position shown in FIG. 4. Next, the new disk 86 is placed in mated relationship over the nut 36 or rotor 34. The new distributor cap 14 of applicant's invention is then attached by means of bolts 30 over the top of the distributor housing 12. The single discharge coil 62 is connected to the output terminal 56 of the distributor housing. Next, discharge wire 70 is connected to discharge post 68 of coil 62 and sparkplug wires 96, 98 are connected to the two sparkplugs 100, 102.

In operation, the rotor 34 rotates, and lobes 38, 40 alternatively engage and disengage movable contact 44. Each time one of lobes 38, 40 engages contact 44, it causes contact 44 to move from a first position in electrical contact with fixed contact 42 to a second position spaced from contact 42. This happens twice with each rotation of rotor 34.

Each time that contact 44 is moved out of contact with contact 42, there is delivered an electrical impulse to outlet terminal 56, and this electrical impulse is transmitted to discharge coil 62. Discharge coil 62 then sends an impulse through wire 70 to the distributor cap 14 and downwardly through brush 85 to the center of rotating disk 86. Brush 85 is positioned over the rotational axis of disk 86 and is in electrical contact with the inner radial end 95 of conductive sheet 90. Continued rotation of disk 86 cause the outer end 97 of conductive sheet 90 to move into electrical contact with the sparkplug contacts 92, 94. However, the conductive sheet 90 moves into contact with contacts 92, 94 one at a time so that current is directed only to one sparkplug at a time.

Thus, it can be seen that the distributor of the present invention causes sparkplug 100 to be actuated, but does not simultaneously cause sparkplug 102 to be actuated. As the disk continues its rotation, the distributor causes the second sparkplug 102 to be actuated, while the first sparkplug 100 is deactuated.

The pie-shaped configuration of metal sheet 90 is important because it permits adjustment of the spark advance of the distributor. The spark advance can be manually adjusted by loosening screws 26 and by rotating base plate 22. This moves contacts 42, 44 relative to lobes 38, 40 of rotor 34 and also relative to disk 86 which is secured over rotor nut 36. The pie-shaped configuration of metal sheet 90 also compensates for the automatic spark advance which occurs in conventional engines in response to increased engine speed. This automatic spark advance is provided by centrifugal cams 110, 112 which are located in lower chamber 23. These cams 110, 112 are pivotally mounted to a cam base 114 for pivotal movement about axes 116. Springs 118 yieldably hold cams 110, 112 against outward radial movement. Each cam 110, 112 includes a cam pawl 120 which is fitted within an opening 122 in rotor 34, which is rotatable on cam shaft 35. Cam base 114 is fixed to cam shaft 35 and rotates in unison with it. As the engine speeds up, centrifugal cams 110, 112 are urged radially outwardly by centrifugal force, and this causes cam pawls 120 to rotate rotor 34 slightly relative to cam shaft 35, thereby advancing the spark as the speed of the engine increases.

The pie-shaped configuration compensates for this automatic spark advance by providing a wide surface for engaging contacts 92, 94. The circumferential width of the outer end 97 of metal sheet 90 is sufficiently large that the sheet 90 will always engage contacts 92, 94 of cap 14 at the same time that lobes 38, 40 of rotor 34 open contacts 42, 44. While the width of outer end 97 of metal sheet 90 may vary, it should be wider than the diameter of contacts 92, 94, and preferably should be two to five times wider.

Gasket 101 functions to prevent sparks or other electrical current to pass between the metal sheet 90 and the contacts 42, 44 located below gasket 101. That is, gasket 101 provides a physical barrier between the metal sheet 90 and the components located within compartment 20. This prevents any shorting or other electrical interference between the space above gasket 101 and the space below gasket 101.

The dish-like depression 93 provides a stabilizing receptacle for receiving the lower end of carbon brush 85. It holds the carbon brush 85 in place at the center of disk 86 and in contact with the inner end 95 of metal sheet 90.

The device is simple in construction, and provides for easy and quick modification of conventional distributors utilized for motorcycles and the like. The original contact points, rotor, condenser, and lower portion of the distributor housing remain intact during the modification, and the new disk 86, distributor cap 14, and single discharge coil 62 are added as described above.

Thus, it can be seen that the device accomplishes at least all of its stated objectives.

What is claimed is:

1. An improvement in a distributor for a two cylinder engine having first and second sparkplugs, said distributor comprising a housing forming a compartment having an open upper end and containing therein a rotor, a stationary contact point, a movable contact point, and spring means normally holding said movable contact point in a closed position in contact with said stationary contact point, said movable contact point being yieldably movable to an open position in spaced relation to said stationary contact point, said rotor having two lobes adapted for rotation to engage said movable contact point and cause said movable contact point to move to its open position twice during each revolution of said rotor, an electrical power circuit connected to said contact points and including an outlet connection, said power circuit being adapted to cause a surge of electrical current to be introduced to said outlet connection each time said movable contact point is moved to its open position, a single discharge coil having an inlet terminal connected to said outlet connection of said power circuit, said discharge coil having a single discharge post, said improvement comprising:

a dielectric gasket positioned in covering relation within said compartment over said stationary contact point and said movable contact point, said gasket having a central opening therein;

a dielectric circular disk above said gasket and having a lower portion extending through said central opening of said gasket and being detachably connected to said rotor for rotation in unison therewith, said disk having a conductive sheet attached thereto positioned above said gasket whereby said gasket provides a physical barrier between said conductive sheet above said gasket and said movable and stationary contacts below said gasket;

coil connection means connecting said discharge post of said coil to said conductive sheet for electrical connection thereto at all times throughout said rotation of said conductive sheet in unison with said rotor;

a first plug contact positioned to electrically engage said conductive sheet during a first portion of each revolution of said disk, second plug contact positioned to electrically engage said conductive sheet during a second portion of each revolution of said disk, means for connecting said first sparkplug to said first plug contact and said second sparkplug to said second plug contact, said first and second plug contacts being positioned to be in contact with said conductive sheet at separate times and not simultaneously during any portion of each revolution of said disk.

2. An improvement according to claim 1 wherein said first and second plug contacts have predetermined diameters, said conductive sheet having an outer end adapted to engage said first and second plug contacts one at a time and having a width greater than said predetermined diameters of said first and second plug contacts.

3. An improvement according to claim 2 wherein said width of said outer end of said conductive sheet is two to five times greater than said predetermined diameters of said first and second plug contacts.

4. An improvement according to claim 1 wherein said first and second plug contacts are mounted to a cap which is mounted in fixed relation to said disk, said coil connection means comprising brush means carried by said cap and positioned to electrically engage said conductive sheet at all times throughout rotation of said disk, said coil connection means further comprising a coil lead means interconnecting said brush means and said coil discharge post.

5. An improvement according to claim 4 wherein said disk rotates in unison with said rotor about a rotor axis, said conductive sheet having a first portion coinciding with said rotor axis and having a second portion positioned radially outwardly from said rotor axis, said brush means engaging said first portion of said conductive sheet and said second portion of said conductive sheet being movable during rotation of said disk into alternating contact with said first and second plug contacts.

6. An improvement according to claim 5 wherein said conductive sheet is wedge-shaped.

7. An improvement according to claim 1 wherein said rotor includes a nut affixed thereto, said disk having a receptacle shaped to fit in mating relation over said nut so as to rotate in unison therewith.

8. An improvement according to claim 7 wherein said first and second plug contacts and said disk are positioned relative to said rotor so that said conductive sheet is alternatively in electrical engagement with one of said first and second plug contacts simultaneously with each time that said rotor moves said movable contact point to said open position.

9. An improvement in a distributor comprising a distributor housing having housing sidewalls forming a rotor compartment, a rotor mounted within said rotor compartment for rotation about a vertical rotor axis, electrical circuitry having fixed and movable contact points within said distributor housing and having an outlet connector, said rotor being movable into engagement with said contact points during rotation of said rotor, said electrical circuitry being responsive to engagement of said contact points by said rotor to deliver periodic surges of current to said outlet connector; a single discharge coil outside said distributor housing, said discharge coil having a single discharge post and having an input terminal connected to said outlet connector of said electrical circuitry; said improvement comprising:

a dielectric gasket positioned within said rotor compartment in covering relation over said fixed and movable contact points, said gasket having a central opening positioned over said rotor;

a dielectric disk above said gasket and having an upper surface and a lower surface, said disk having a lower portion extending downwardly through said central opening of said gasket and being detachably secured to said rotor for rotation in unison with said rotor about said vertical rotor axis, said disk having a conductive member positioned above said gasket;

cap means adapted to be fixedly attached to said housing above said dielectric disk, said cap means having a plurality of plug contacts positioned to be engaged at times by said conductive member during rotation of said disk, when said cap means is attached to said housing;

said cap means having brush means positioned to engage said conductive member at all times during rotation of said disk when said cap means is attached to said housing;

each of said plug contacts having a sparkplug lead connected thereto and extending through said cap means for connection to a sparkplug;

a coil discharge connector connecting said discharge post of said discharge coil to said brush means;

the size and shape of said conductive member and the positions of said plug contacts relative to said conductive member being chosen so that said conductive member engages said plug contacts one at a time during rotation of said disk;

said dielectric gasket forming a physical barrier between said conductive member above said gasket and said fixed contact point and said movable contact point below said gasket.

* * * * *